US010426210B2

(12) United States Patent
Hong

(10) Patent No.: US 10,426,210 B2
(45) Date of Patent: Oct. 1, 2019

(54) KNOTTING SYSTEM, KNOTTING METHOD, AND METHOD FOR PRODUCING WIG USING SAME

(71) Applicant: HIMO INC., Seoul (KR)

(72) Inventor: In Pyo Hong, Seoul (KR)

(73) Assignee: HIMO, INC., Seoul (KR)

( * ) Notice: Subject to any disclaimer, the term of this patent is extended or adjusted under 35 U.S.C. 154(b) by 0 days.

(21) Appl. No.: 15/742,509

(22) PCT Filed: Jun. 23, 2016

(86) PCT No.: PCT/KR2016/006709
§ 371 (c)(1),
(2) Date: Jan. 6, 2018

(87) PCT Pub. No.: WO2017/007153
PCT Pub. Date: Jan. 12, 2017

(65) Prior Publication Data

US 2018/0199649 A1 Jul. 19, 2018

(30) Foreign Application Priority Data

Jul. 6, 2015 (KR) ..... 10-2015-0095835

(51) Int. Cl.
*A41G 3/00* (2006.01)

(52) U.S. Cl.
CPC ..... *A41G 3/0075* (2013.01); *A41G 3/0066* (2013.01); *A41G 3/0083* (2013.01)

(58) Field of Classification Search
CPC .. A41G 3/0075; A41G 3/0066; A41G 3/0083; B65H 69/046; B65H 69/04;
(Continued)

(56) References Cited

U.S. PATENT DOCUMENTS 3,903,903 A * 9/1975 Matsumura ..... A41G 3/0066 132/201
4,188,894 A * 2/1980 Matsumura ..... D05C 15/02 112/156
4,568,116 A * 2/1986 Kohlen ..... B65H 69/04 289/2

FOREIGN PATENT DOCUMENTS

JP H03-011589 U 2/1991
JP H03-072401 U 3/2011
(Continued)

OTHER PUBLICATIONS

Extended Search Report for corresponding European Patent Application No. 16821559.8 dated May 25, 2018.
(Continued)

*Primary Examiner* — Nathan E Durham
*Assistant Examiner* — Abby M Spatz
(74) *Attorney, Agent, or Firm* — Wegman Hessler

(57) ABSTRACT

A hair knotting system comprises one or more hair knotting apparatuses, installed along the feed direction of the thread, for knotting hair on a thread. The hair knotting apparatus comprises: an insertion groove into which one or more strands of hair are inserted; a hair insertion member having a pull-out hole on the bottom surface of the insertion groove; a hair pull-out member for taking hold and pulling out the hair, which has been inserted in the insertion groove, through the pull-out hole so as to be positioned past the thread from below, and forming a knotting hole as the thread and hair connect; a hair knotting member penetrating the knotting hole from bottom to top to be positioned above the thread; and a hair winding member for taking hold of both ends of the hair pulled out from the hair insertion member, and winding both ends of the hair while rotating around the hair knotting member past the thread from above, wherein the hair knotting member knots the hair on the thread by
(Continued)

pulling both ends of the wound hair downward through the knotting hole.

17 Claims, 26 Drawing Sheets

(58) Field of Classification Search
CPC ..... A01D 59/04; D05C 15/02; D05C 15/00; D04D 7/08; D04G 5/00; G05B 2219/45195
USPC ..... 132/56; 112/79.5, 156, 470.22, 22; 289/1.5, 2
See application file for complete search history.

(56) References Cited

FOREIGN PATENT DOCUMENTS

| | | | |
|---|---|---|---|
| KR | 10-0700320 | B | 3/2007 |
| KR | 10-0729914 | B | 6/2007 |
| KR | 10-0871928 | B | 12/2008 |
| KR | 10-2009-0099416 | A | 9/2009 |
| KR | 10-2014-0132096 | A | 11/2014 |
| WO | 2010090191 | | 8/2010 |

OTHER PUBLICATIONS

International Search Report and Written Opinion issued in connection with corresponding PCT Application No. PCT/KR2016/006709 dated Oct. 25, 2016.

* cited by examiner

KNOTTING SYSTEM, KNOTTING METHOD, AND METHOD FOR PRODUCING WIG USING SAME

CROSS-REFERENCE TO RELATED APPLICATIONS

This application is the U.S. national phase entry of International Patent Application No. PCT/KR2016/006709 filed Jun. 23, 2016, which claims priority to Korean Patent Application No. 2015-95835, filed on Jul. 06, 2015, all of the above listed applications are herein incorporated by reference.

TECHNICAL FIELD

The present invention relates to a knotting system, a knotting method, and a method for producing a wig using the same, wherein hairs for producing a hair extension and a wig are automatically knotted and the wig is produced by using knots.

BACKGROUND ART

In general, due to physical hereditary influence, pollution with social development, or the like, wide-spread phenomena of hair loss have been appearing. In particular, due to causes such as physical aging, drug abuse, psychological stress, hairs fall out and the volume of hair decreases, and thus, a certain portion of head skin is exposed and an ill appearance appears.

Due to such hair loss, in general, methods of using a wig, implanting hairs through a surgical operation, or the like are used to hide the exposed head skin portion.

DISCLOSURE OF THE INVENTION

Technical Problem

Wigs according to conventional arts had a limitation in that hairs should be manually knotted and thus efficiency and continuity of work are degraded.

The present invention is devised to solve the foregoing limitation, and the purpose thereof is to provide a knotting system in which hairs are automatically knotted to improve efficiency and continuity of work.

Technical Solution

According to an aspect of the present invention, there is provided a hair knotting system including one or more hair knotting apparatuses installed in a feeding direction of a thread and configured to knot hairs to the thread, the hair knotting apparatus including: a hair insertion member having an insertion groove into which one or more hairs are inserted, and a pull-out hole formed on a bottom surface of the insertion groove; a hair pull-out member for picking up and pulling out the hair, which has been inserted in the insertion groove, through the pull-out hole so as to be positioned past a portion under the thread, and forming a knotting hole as the thread and hair connect; a hair knotting member passing through the knotting hole from bottom to top so as to be positioned above the thread; and a hair winding member for picking up both end portions of the hair pulled out from the hair insertion member, and winding both the end portions of the hair while rotating around the hair knotting member above the thread, wherein the hair knotting member knots the hair onto the thread by pulling down, through the knotting hole, both end portions of the hair wound around a circumferential surface of the hair knotting member.

The inserting groove may be formed in a "U"-shape opened upward, and the pull-out hole may be formed on a center of a bottom surface of the inserting groove formed in the "U"-shape.

The hair insertion member may include a pressing member for pressing the hair inserted in the inserting groove.

The hair pull-out member may include: a hair pull-out piece which linearly moves so as to be inserted into or pulled out from the pull-out hole and has a hanging hook which is formed on the tip thereof and on which one or more hairs inserted into the inserting groove are hung; and a first driving member for linearly moving the pull-out member.

The hair knotting member may include: a hair knotting piece which linearly moves so as to be inserted into or pulled out from the knotting hole from bottom to up, and has a hanging hook which is formed on a tip thereof and on which the hair wound around the tip is hung and picked up; and a third driving member for linearly moving the hair knotting member.

The hair winding member may include: a winding piece comprising a linear part provide on one side of the winding member, and a curved part provided on the tip of the linear part, protruding in a direction toward the knotting member, and having a winding hole which is formed therein and through which the hair pulled out from the insertion hole; and a fourth driving member which moves the winding member so that the curved part of the winding member passes through the knotting member or returns to an original position, wherein when the winding member is moved and passes through the knotting member by means of the fourth driving member and returns to the original position, the hair having passed through the winding hole may be wound around the knotting member and knotted while the winding hole is rotated one turn around the knotting member.

The knotting system may further include a hair expanding member which causes both end portions of the hair having passed the thread to be spaced apart from each other and thereby expands the knotting hole.

The hair expanding member may include: a hair expanding piece provided above the hair, which has passed and positioned under the thread, so as to be movable in a vertical direction, and having an "M"-shaped groove on which both ends of the hair are hung and further separated from each other; and a second driving member for moving the hair expanding member in the vertical direction.

The knotting system may further include a hair moving member for moving a knotted hair which has been knotted onto one side of the thread to the other side of the thread.

The hair moving member may include: a moving piece which linearly moves in a lengthwise direction of the thread, has a through hole through which the thread passes, and moves the knotted hair knotted onto the thread while a through hole through which the thread passes; and a fifth driving member for linearly moving the moving piece.

The knotting system may further include a hair recovering member which picks up hairs, which has not yet been knotted by the hair knotting member, and moves the hairs to a predetermined place to recover the hairs.

The hair recovering member may include: a hair recovering member which linearly moves toward the pull-out hole of the hair insertion member 210 and grips the hair pulled out from the pull-out hole and moves the hair to a predetermined place on a tip thereof; and a sixth driving member for linearly moving the hair recovering member.

The knotting system may further include a thread supply apparatus 100 for supplying the thread from one side to the other side thereof.

According to another aspect of the present invention, there is provided a knotting method comprising: (a) a step of inserting one or more hairs into an insertion groove of a hair insertion member; (b) a step of inserting a hair pull-out member into a pull-out hole of the hair insertion member and picking up the hair inserted into the insertion groove, then pulling out the hair so that the hair is positioned past a portion under a thread, and then forming a knotting hole while the thread and the hair are connected; (d) a step of moving a hair knotting member 240 to pass through the knotting hole from bottom to top; (e) a step of winding both end portions of the hair pulled out from the pull-out hole around the hair winding member positioned above the thread by using a hair winding member; (f) a step of pulling down, through the knotting hole, both the end portions of the hair wound around the hair knotting member, thereby knotting the hair onto the thread.

The knotting method may include (c) a step of expanding the knotting hole by using a hair expanding member, between steps (b) and (d).

The knotting method may include (g) a step of moving and aligning the knotted hair knotted on one side of the thread by using a hair moving member to the other side of the thread after step (f).

The knotting method may include (h) a step of moving the hairs, which remain without being knotted onto the thread, to a predetermined position, thereby recovering the hairs, after step (g).

According to still another aspect of the present invention, there is provided a method for producing a wig, comprising: (A) a step of producing a long knotted thread onto which a plurality of knitted hairs are knotted; (B) a step of producing a unit knotted thread by cutting the knotted thread produced in step (A) into a predetermined size; (C) a step of horizontally and vertically aligning the unit knotted threads produced in step (B) and weaves the unit knotted threads to produce a wig.

The step (A) may include a step of applying an adhesive on a plurality of knotted hairs knotted onto the thread and thereby fixing the knotted hairs.

Advantageous Effects

A knotting device and a knotting method according to the present invention have an effect of automating hair knotting onto threads and thereby enabling improvement in work efficiency.

BRIEF DESCRIPTION OF THE DRAWINGS

FIG. 16 is a view schematically illustrating a hair inserting step, FIG. 17 is a view schematically illustrating a hair pull-out step, FIG. 18 is a view schematically illustrating a hair expanding step, FIGS. 19 and 20 are views schematically illustrating a hair knot preparing step.

MODE FOR CARRYING OUT THE INVENTION

Figure 1:
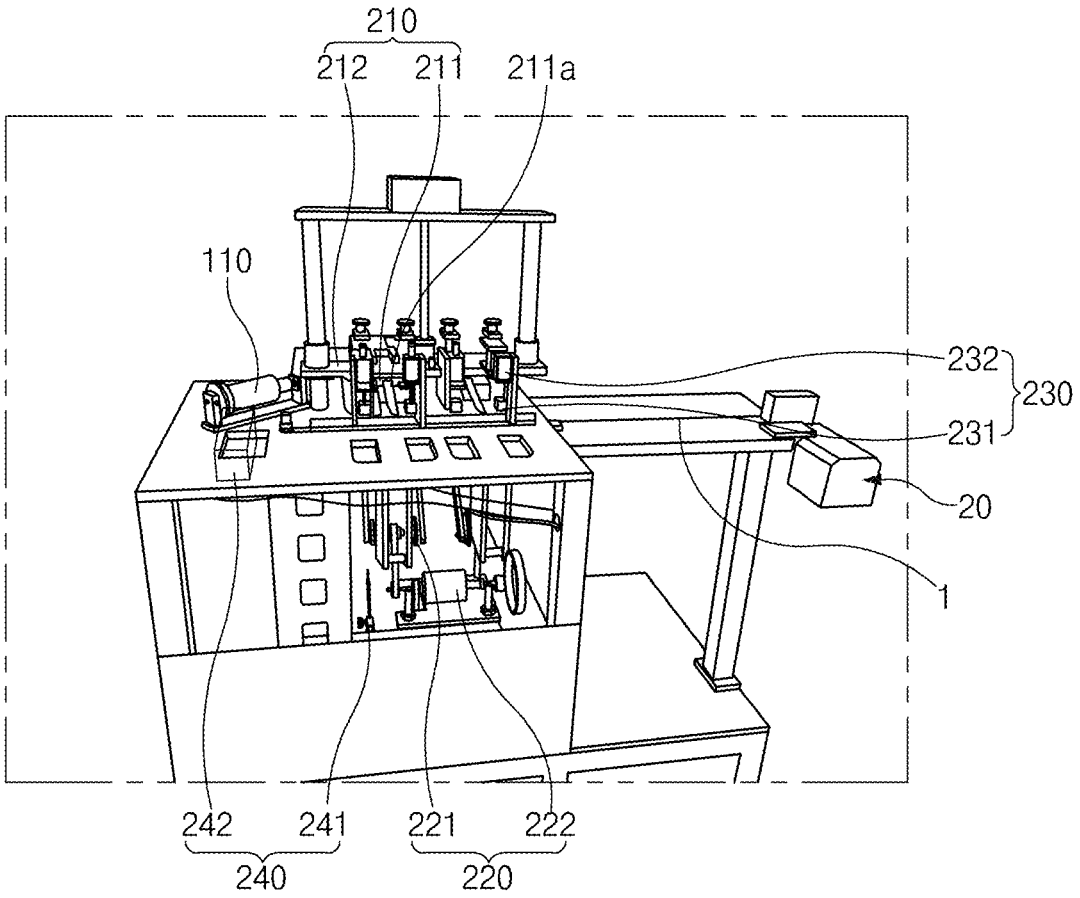
FIG. 1 is a front perspective view illustrating a knotting system according to the present invention.

Hereinafter preferred embodiments of the present invention will be described in detail with reference to the accompanying drawings in such a manner that the technical idea of the present invention may easily be carried out by a person with ordinary skill in the art to which the invention pertains. The present invention may, however, be embodied in different forms and should not be construed as limited to the embodiments described herein. In the figures, the portions unrelated to descriptions are not provided for clarity of illustration, and like reference numerals refer to like elements throughout.

In addition, in indicating a direction for description, meanings of the left side and the right side are with respect to the direction of viewing drawings.

A knotting system according to the present invention is for automating hair knotting onto threads and thereby achieving work efficiency and cost reduction.

Hereinafter a knotting system according to the present invention will be described in detail with reference to the accompanying drawings.

[Knotting System]

Figure 2:
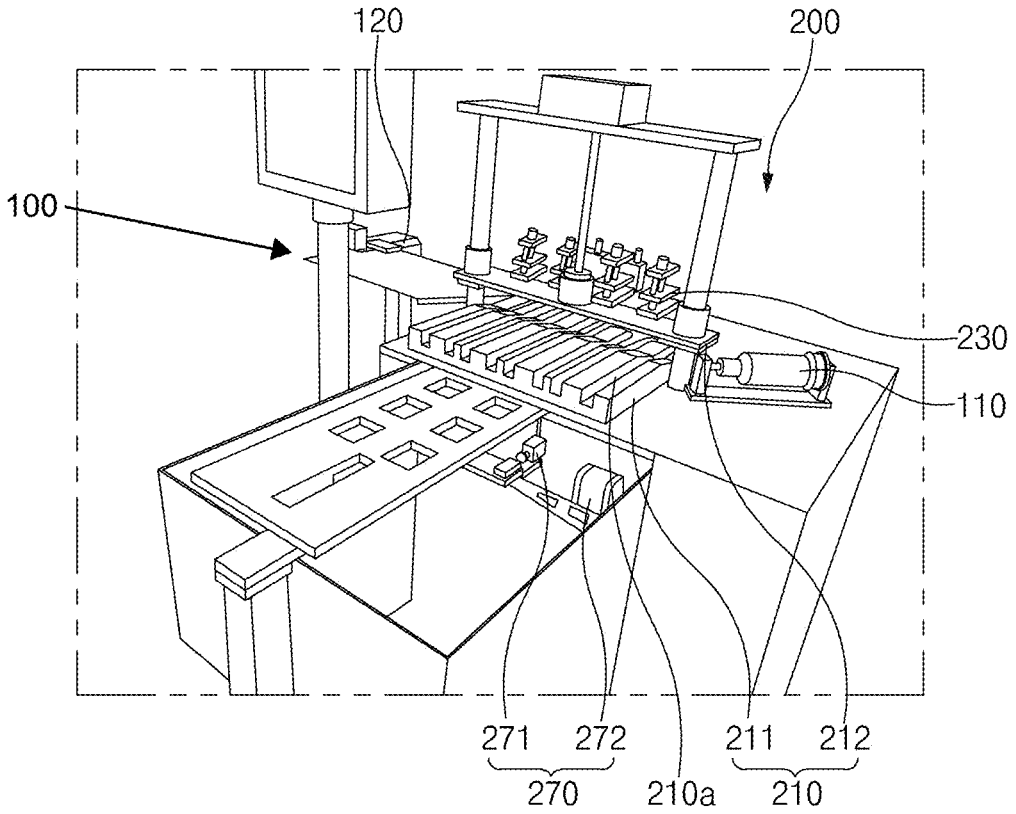
FIG. 2 is a rear perspective view illustrating the knotting system according to the present invention.
Figure 3:
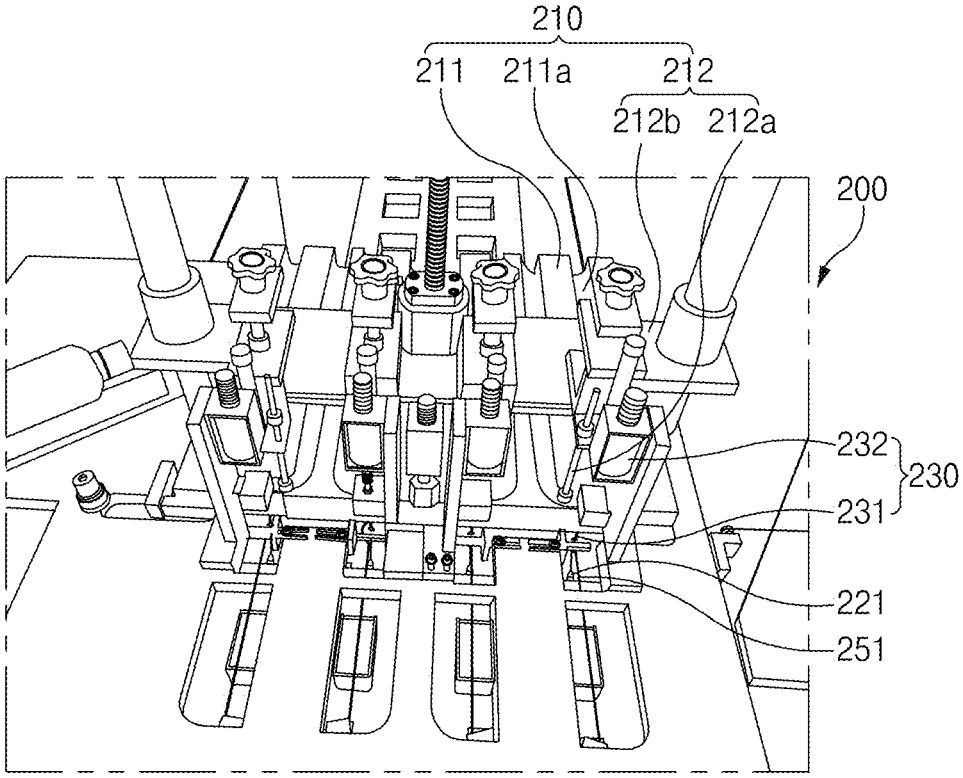
FIG. 3 is a front perspective view illustrating the knotting system according to the present invention.

As illustrated in FIGS. 1 to 3, a knotting system according to the present invention includes: a thread supply apparatus 100 for feeding a thread 1 from one side to the other side thereof; and a knotting apparatus 200 for knotting one or more hairs onto the thread 1 fed by the thread supply apparatus 100.

1. Thread Supply Apparatus

The thread supply apparatus 100 includes: a winding member 110 around which the thread 1 is wound; and a feeding member 120 which moves and feeds the thread 1 wound around the winding member 110 to a predetermined position.

The winding member 110 may have a roll shape. That is, the winding member 110 and the feeding member 120 are respectively provided on one side and the other side of the thread supply apparatus, and the thread 1 wound around the winding member 110 are connected to the feeding member 120. In this state, when the feeding member 120 is driven, the thread 1 wound around the winding member 110 is moved and fed by the feeding member 120.

Meanwhile, when a hair 2 is knotted onto the thread 1 by the knotting apparatus 200, the thread supply apparatus 100 stops the movement of the thread 1, and then when the hair 2 is knotted onto the thread 1, the thread supply apparatus 100 moves the thread 1 and thereby positions a portion of thread 1, onto which a hair 2 has not yet been knotted, in front of the knotting apparatus 200.

2. Knotting Apparatus

As illustrated in FIGS. 4 to 7, the knitting apparatus 200 is an apparatus for automatically knotting hairs 2 onto the thread 1 moved by the thread supply apparatus, and includes: a hair insertion member 210 into which one or more hairs 2 are inserted; a hair pull-out member 220 which picks up one sides of the hairs 2 inserted in the hair insertion member 210 and pulls out the one sides of the hairs 2 so that a portion of the hairs 2 passes under the thread 1 and which forms a knotting hole 2*a* between the hairs 2 and the thread 1; a hair expanding member 230 which increases distance between both end portions pulled out by the hair pull-out member 220 to thereby expands the knotting hole 2*a*; a hair knotting member 240 which passes through the knotting hole 2*a* from bottom to top; and a hair winding member 250 which winds both the ends of the hairs 2 around the hair knotting member 240 above the thread 1, wherein when the hairs 2 are wound by the hair winding member 250, the hair knotting member 240 pulls down both end portions of the wound hairs, while moving under the knotting hole 2*a*, to thereby knots the hairs 2 onto the thread 1.

Meanwhile, the knotting apparatus 200 includes: a hair moving member 260 for moving the knotted hair 20 knotted onto one side of the thread 1 to the other side of the thread 1; and a hair recovering member 270 for pulling out and recovering the hair 2 which has not yet been knotted onto the thread 1 from the hair insertion member 210.

In this case, referring to FIGS. 1 to 3, the knotting apparatus 200 is installed with respect to the thread 1 supplied by the thread supply apparatus 100. That is, the hair insertion member 210 is provided on a lower left side of the thread 1, the hair pull-out member 220 is provided on a lower right side of the thread 1, the hair expanding member 230 is provided above a portion between the thread 1 and the hair pull-out member 220, a hair knotting member 240 is provided under a portion between the thread 1 and the hair pull-out member 220, the hair winding member 250 is provided under the hair pull-out member 220, the hair moving member 260 is provided on the side of feeding the thread 1, and the hair recovering member 270 is provided under the hair insertion member 210.

Hair Insertion Member

Figure 4:
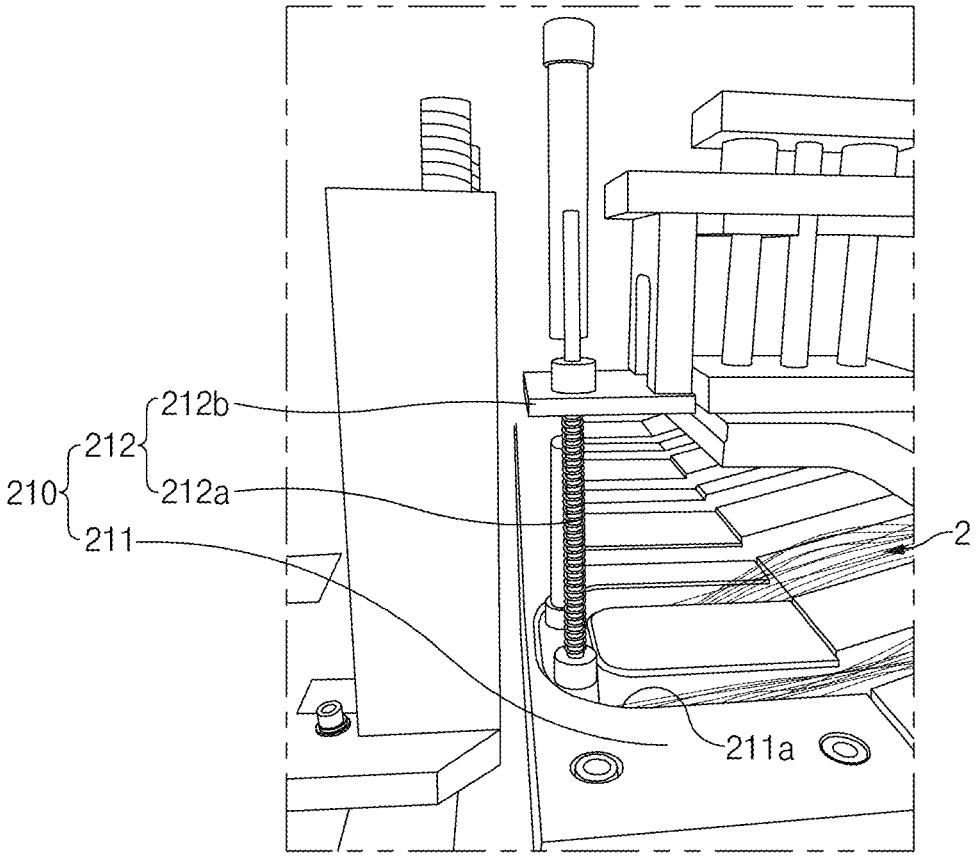
FIG. 4 is a perspective view illustrating a hair insertion member according to the present invention.
Figure 5:
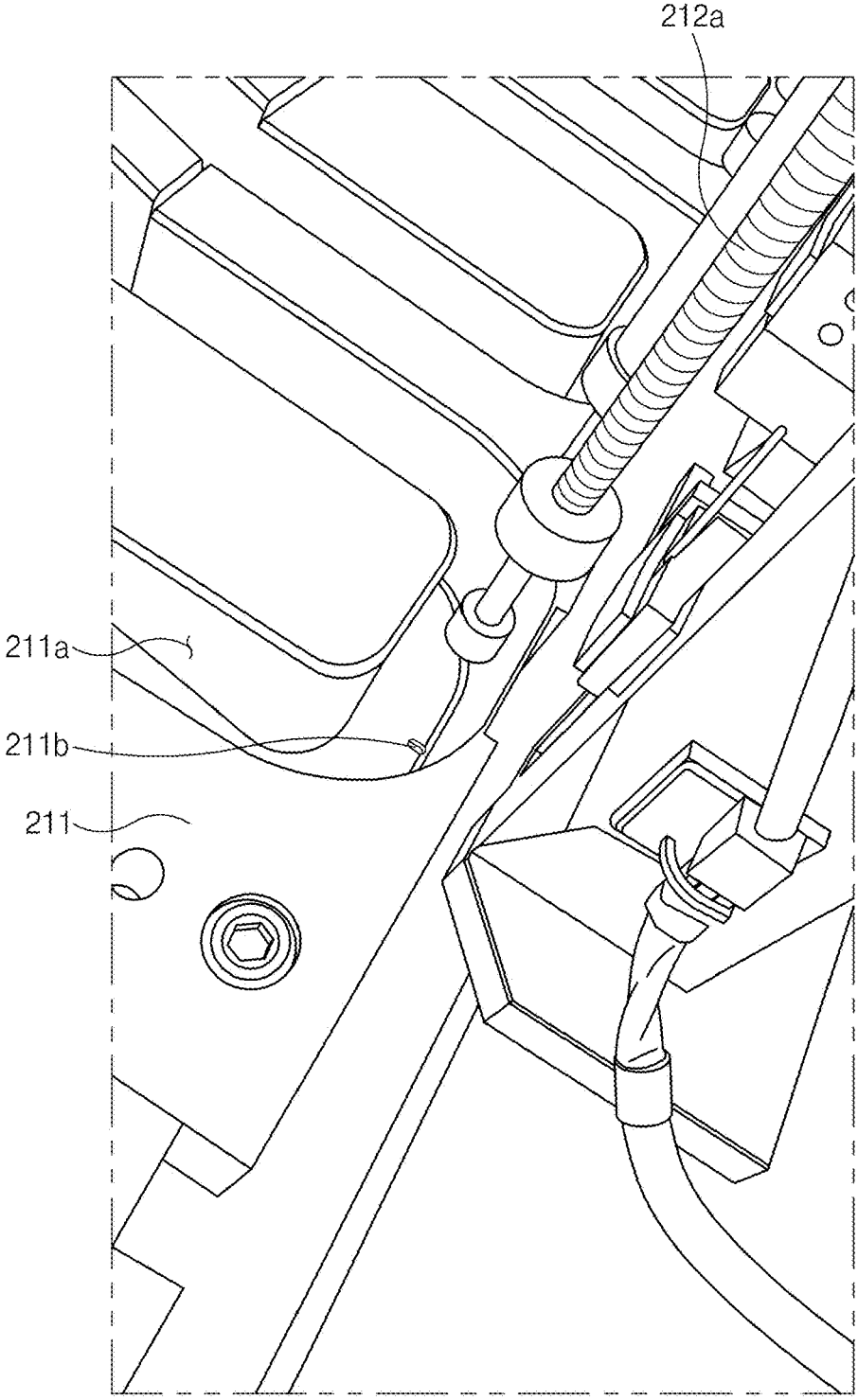
FIG. 5 is a partially expanded view of FIG. 4.

As illustrated in FIGS. 4 and 5, the hair insertion member 210 includes: an insertion member 211 which is for inserting the plurality of hairs thereinto and storing the hairs therein, into which the hairs 2 are inserted, and from which a portion of the inserted hairs are pulled out; and a pressing member 212 which presses the hairs 2 inserted into the insertion member 211 with a predetermined pressure.

The insertion member 211 has: on the upper surface thereof, an insertion groove 211*a* into which one or more hairs 2 are inserted; and a pull-out hole 211*b* formed on the bottom surface of the insertion hole 211.

In this case, the insertion groove 211*a* may be formed in a "U"-shape opened upward, so that the size of the insertion member 211 may be minimized while an amount of the inserted hairs 2 are maintained as it is.

The pull-out hole 211*b* is formed on the central bottom of the "U"-shaped insertion groove 211*a*, and particularly formed to be inclined downward toward the hair pull-out member 220 attached to be inclined. In this case, the size of the pull-out hole 211*b* has a minimum size such that the hair pull-out member 220 can be inserted into the pull-out hole without interference.

The pressing member 212 includes a pressing part 212*a* which is provided above the insertion member 211 to be able to move toward the insertion groove 211*a* and presses and fixes the hairs 2 inserted into the insertion groove 211*a*; and a cylinder part 212*b* for moving the pressing part 212*a* toward the insertion groove 211*a*, wherein the pressing part 212*a* may be vertically moved along a guide part 212*c*.

That is, the pressing member 212 may not only prevent the movements of the hairs 2, but also always position the hairs 2 adjacent to the pull-out hole 211*b* regardless of the number of hairs 2 inserted into the insertion member 211.

Hair Pull-Out Member

Figure 6:
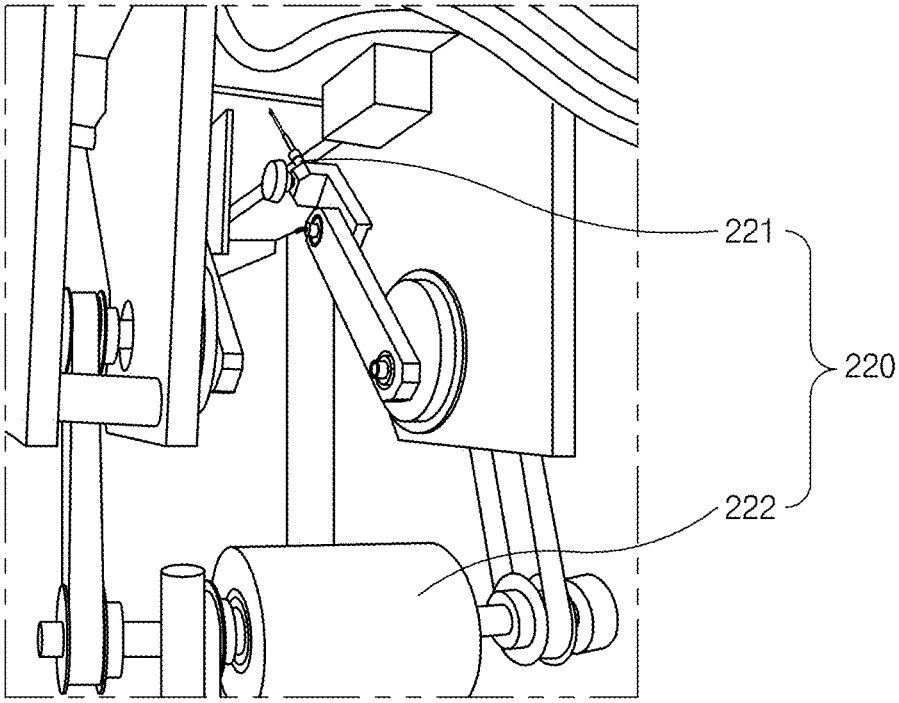
FIG. 6 is a perspective view illustrating a hair pull-out member according to the present invention.
Figure 7:
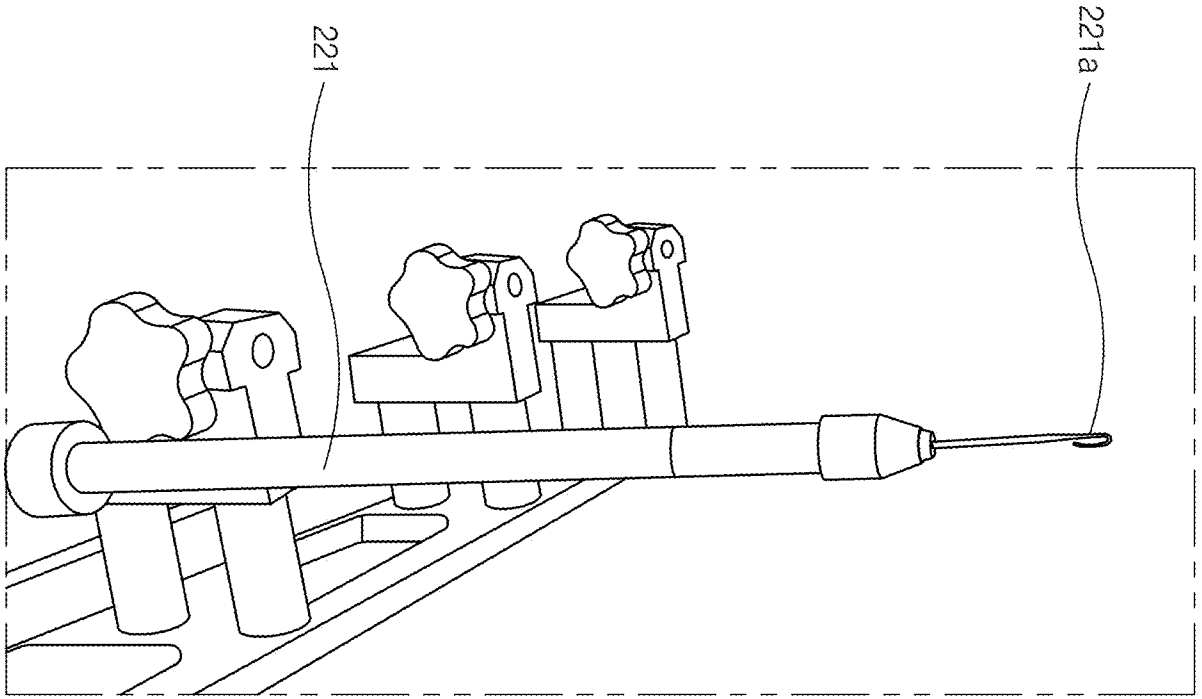
FIG. 7 is a partially expanded view of FIG. 6.

As illustrated in FIGS. 6 and 7, the hair pull-out member 220 is for pulling a hair 2 inserted into the hair insertion member 210 out of the hair insertion member 210 while picking up the center of the hair 2 inserted into the hair insertion member 210. That is, while the hair 2 inserted into the insertion groove 211*a* is picked up and pulled out through the pull-out hole 211*b* so as to be positioned past a portion under the thread 1, a knotting hole 2*a* is formed at a connecting portion while the thread 1 and the hairs 2 overlap and are connected (see FIG. 17). That is, an approximately circular knotting hole 2*a* is formed while the "U"-shaped hair 2 passes a portion under the thread 1.

More specifically, the hair pull-out member 220 includes: a hair pull-out piece 221 which linearly moves so as to be inserted into or pulled out from the pull-out hole 211*b* and has, on the tip thereof, a hanging hook 221*a* on which one or more hairs 2 inserted into the insertion groove 211*a* are hung and picked up; and a first driving member 222 for linearly moving the hair pull-out piece 221.

Hair Expansion Member

Figure 8:
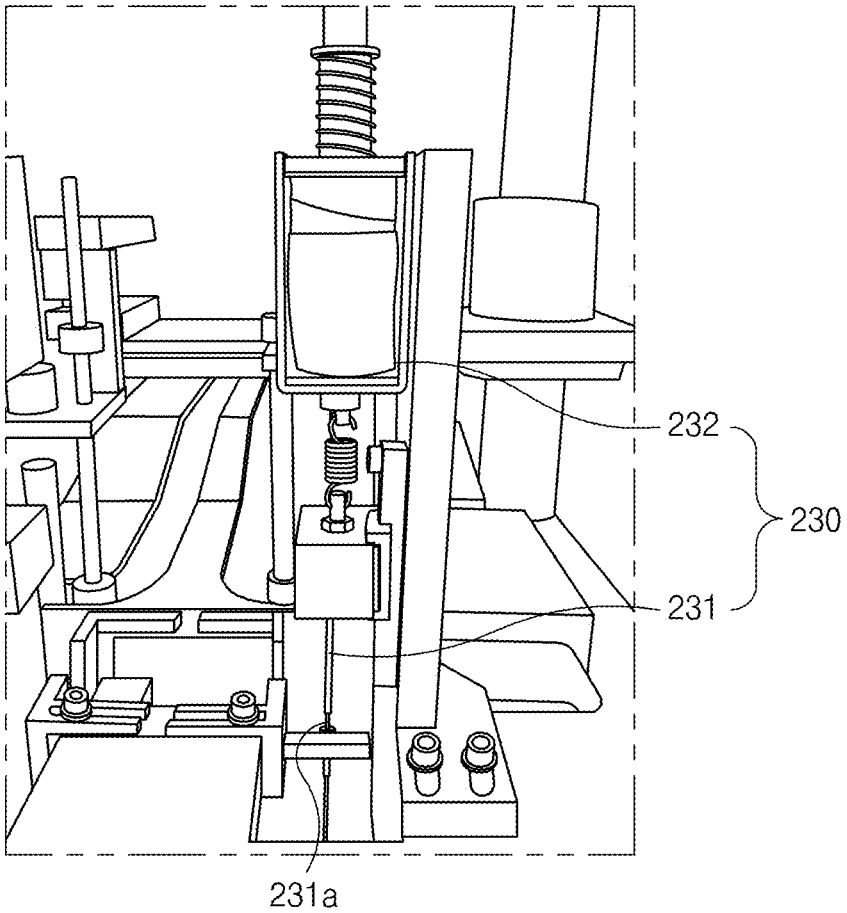
FIG. 8 is a perspective view illustrating a hair expanding member according to the present invention.
Figure 9:
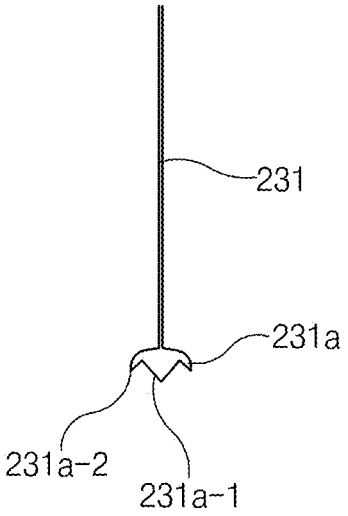
FIG. 9 is a partially expanded view of FIG. 8.

As illustrated in FIGS. 8 and 9, the hair expansion member 230 is a member for expanding the size of the knotting hole 2*a* formed between the thread 1 and the hair 2 and includes: a hair expanding member 231 which is installed above a portion between the thread 1 and the hair pull-out member 220, linearly moves up or down in the vertical direction toward the knotting hole 2*a*, and has an "M"-shaped expanding part 231*a* which is formed on the tip thereof and on the tip of which both end portions of the hair 2 are hung and further separated; and a second driving member 232 for linearly moving the hair expanding member 231.

That is, in the hair expanding member 231, a central protrusion 231*a*-1 is inserted into the knotting hole 2*a* and both the ends of the hair 2 are respectively inserted into expanding grooves 231*a*-2 on both sides of a central protrusion 231*a*-1, and in this case, end portions of the hair inserted into the expanding groove 231*a*-2 are further separated from each other while being guided along the inclined surfaces of the expansion grooves 231*a*-2.

Hair Knotting Member

Figure 10:
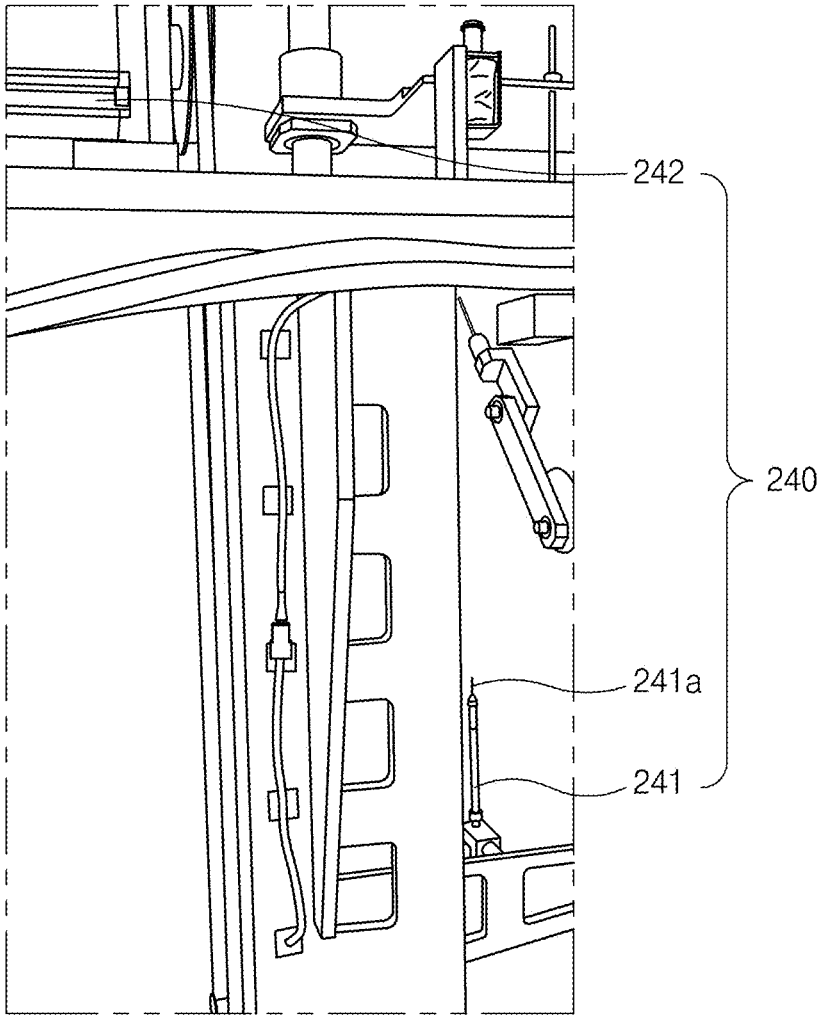
FIG. 10 is a perspective view illustrating a hair knotting member according to the present invention.

As illustrated in FIG. 10, the hair knotting member 240 is a member for knotting the hair onto the thread, and includes: a hair knotting piece 241 which passes through the knotting hole 2*a* from bottom to top and linearly moves to be positioned at an upper portion of the thread 1; and a third driving member 242 for linearly moving the hair knotting piece 241, wherein a hanging hook 241*a* having a hook shape or a fishing needle shape is formed on the tip of the hair knotting piece 241 so that the hair 2 wound by the hair winding member 250 is hung and pulled by the hanging hook.

Hair Winding Member

Figure 11:
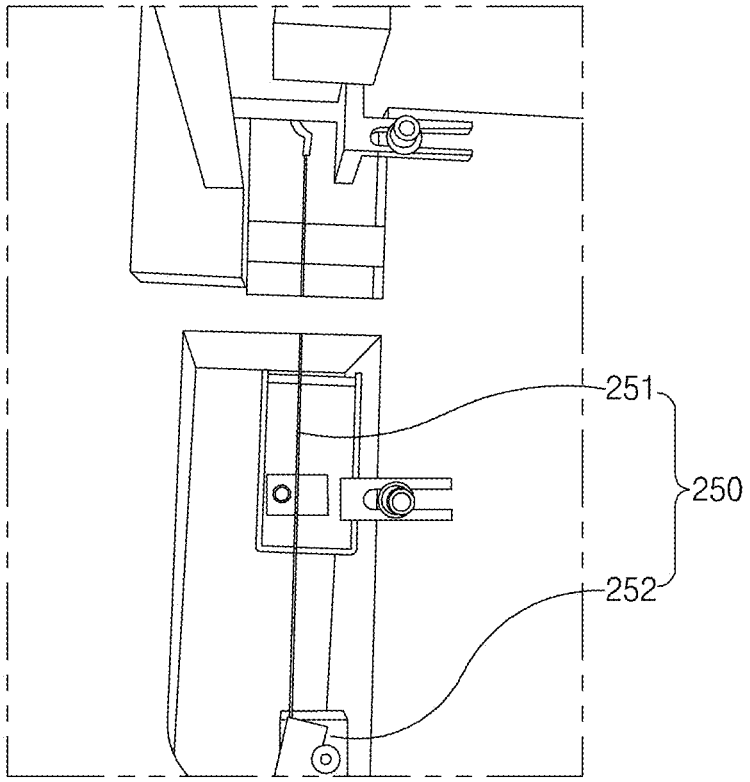
FIG. 11 is a perspective view illustrating a hair winding member according to the present invention.
Figure 12:
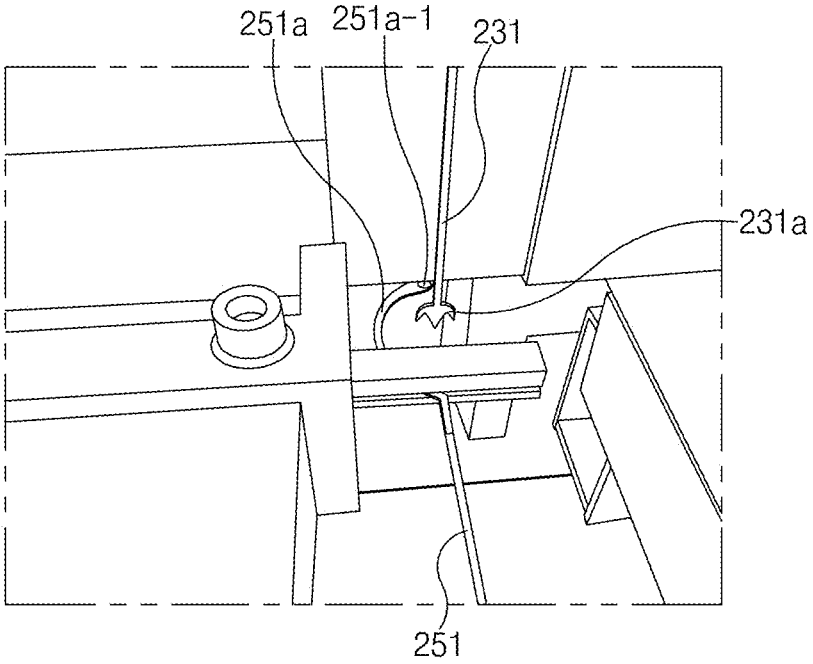
FIG. 12 is a partially expanded view of FIG. 11.

As illustrated in FIGS. 11 and 12, the hair winding member 250 picks up both ends of the hair pulled out from the hair insertion member 210 and winds the both the ends of the hair 2 while being rotated around the hair pull-out member 211 of the hair knotting member 240 above the thread 1.

That is, the hair winding member 250 includes: a hair winding piece 251 which is provided to be movable toward the hair knotting member 240 and having a curved part 251*a* which protrudes in the direction toward the hair knotting piece 241 of the hair knotting member 240, and has a winding hole 251-*a* through which the hair 2 pulled out from the pull-out hole 211*b* passes; and a fourth driving member 252 which moves the curved part 251*a* of the hair winding member 251 to pass through the hair knotting piece 241 of the hair knotting member 240 or return to an original position.

The hair winding piece 251 of the hair winding member 250 is linearly reciprocated by the fourth driving member 252, and in this case, when the hair winding piece 251 moves forward, a protruding surface of the curved part 251*a* of the hair winding piece 251 is supported on one side of the hair knotting piece 241, a recessed groove of the curved part 251*a* is supported on the other side of the hair knotting piece 241, and thus, the hair 2 positioned on the winding hole 251*a*-1 is wound one turn around the hair knotting piece 241 while the winding hole 251*a*-1 is rotated one turn around the hair knotting piece 241.

Hair Moving Member

Figure 13:
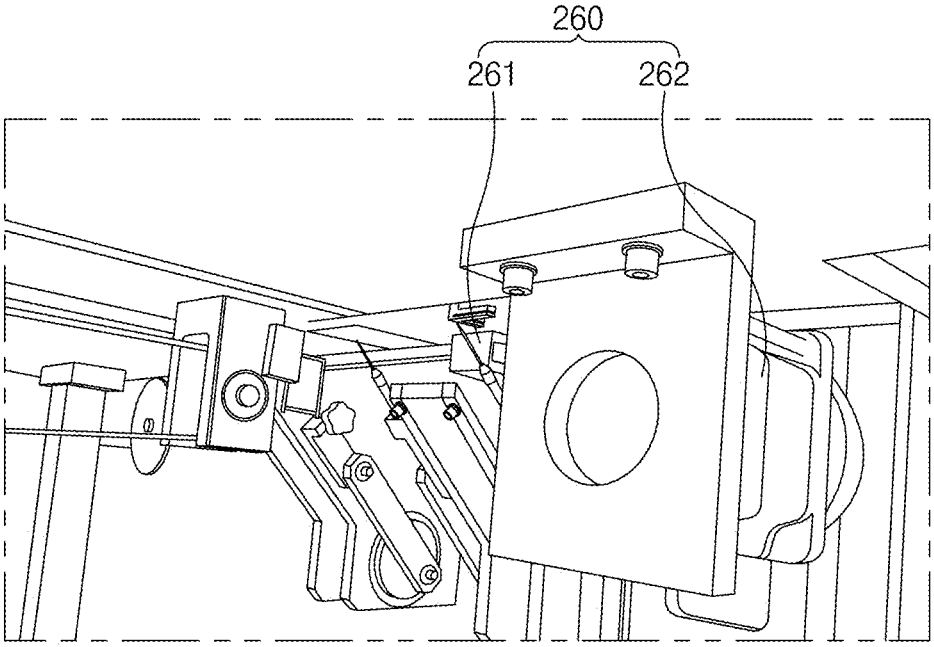
FIG. 13 is a perspective view illustrating a hair moving member according to the present invention.

As illustrated in FIG. 13, the hair moving member 260 is a member for moving the knotted hair 20 knotted onto the thread 1 so as to be aligned on one side of the thread 1 and includes: a moving piece 261 which has a through hole, through which the thread 1 passes through, and moves the knotting hair 20 knotted on the other side of the thread 1 while moving from one side to the other side along the thread 1; and a fifth member 262 for moving the moving piece 261 in the moving direction of the thread 1.

That is, the hair moving member 260 biases the knotting hair 20 knotted onto the thread 1 to one side so that the knotted hairs 20 are densely disposed, and then, the thread 1 on which knotting hairs 20 are densely disposed is cut into a predetermined size to produce a knotted thread 10.

Hair Recovering Member

Figure 14:
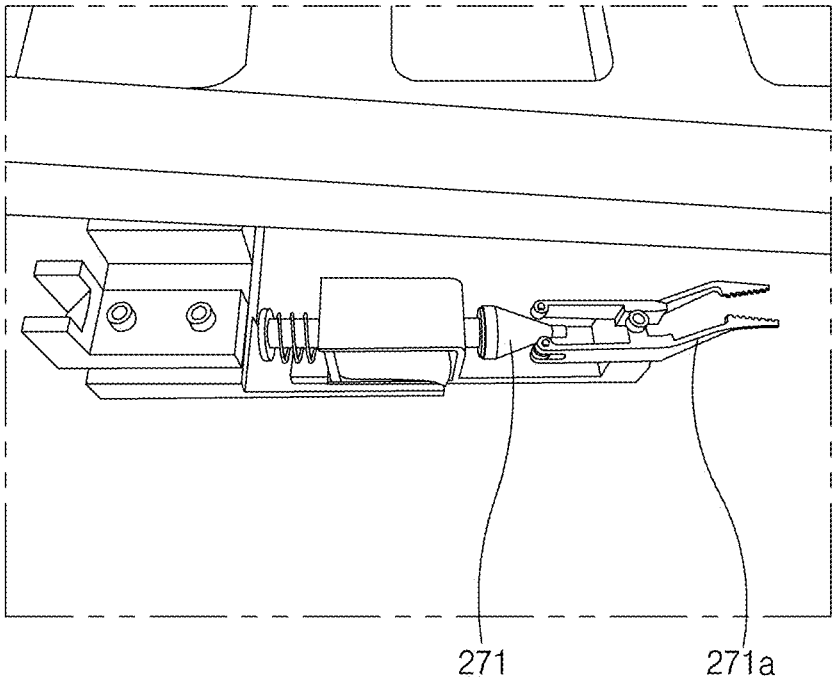
FIG. 14 is a perspective view illustrating a hair recovering member according to the present invention.

As illustrated in FIG. 14, the hair recovering member 270 is a member for removing hairs 2 which are not knotted onto the thread 1 among the hairs 2 pulled out from the hair insertion member 210, and which is a member for preventing a problem in that the remaining hairs 2 and hairs 2 pulled out during a knotting process are entangled.

That is, the hair recovering member 270 includes: a hair recovering piece 271 which linearly moves toward the pull-out holes of the hair insertion member 210 and has a pick up part 271*a* which picks up the hair pulled out from the pull-out holes; and a sixth driving member 272 for linearly moving the hair recovering member 271.

[Knotting Method]

Hereinafter a knotting method using a knotting system having the above-mentioned configuration according to the present invention will be described.

Figure 15:
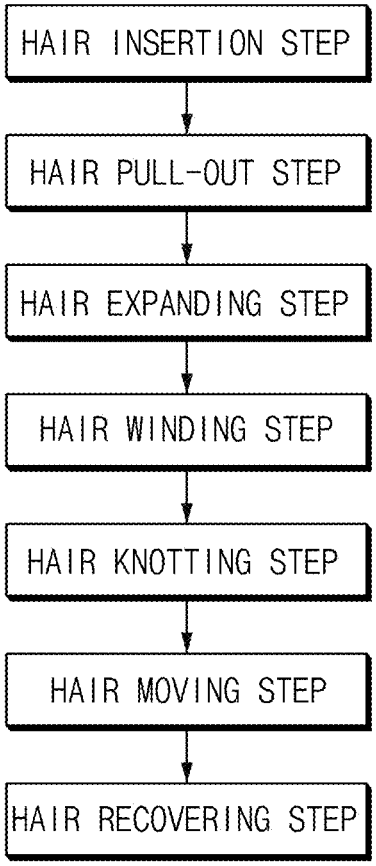
FIG. 15 is a flowchart illustrating a knotting method using a knotting system according the present invention.

As illustrated in FIG. 15, a knotting method according to the present invention may include: (a) a step of inserting one or more hairs into an insertion groove of a hair insertion member 210; (b) a step of inserting a hair pull-out member 220 into a pull-out hole of the hair insertion member 210 and picking up the hairs inserted into the insertion groove, then pulling out the hair so that the hair is positioned past a portion under a thread, and then forming a knotting hole while the thread and the hair are connected; (c) a step of expanding the knotting hole using a hair expanding member 230; (d) a step of moving a hair knotting member 240 to pass through the knotting hole from bottom to top; (e) a step of winding both end portions of the hair pulled out from the pull-out hole by using a hair winding member 250; (f) a step of pulling down, through the knotting hole, both the end portions of the hair wound around the hair knotting member 240, thereby knotting the hair onto the thread; (g) a step of moving and aligning the knotted hair knotted on one side of the thread by using a hair moving member 260 to the other side of the thread; and (h) a step of moving the hairs which remain without being knotted onto the thread to a predetermined position, thereby recovering the hairs.

The knotting method according to the present invention will be more specifically described.

Before performing the knotting method, a thread 1 is supplied through a thread supply apparatus 100 so as to be connected from one end to the other end of the apparatus. That is, referring to FIGS. 1 and 2, the thread 1 wound around a winding member 110 is connected to a feeding member 120 to be supplied to the feeding member 120.

Figure 16:
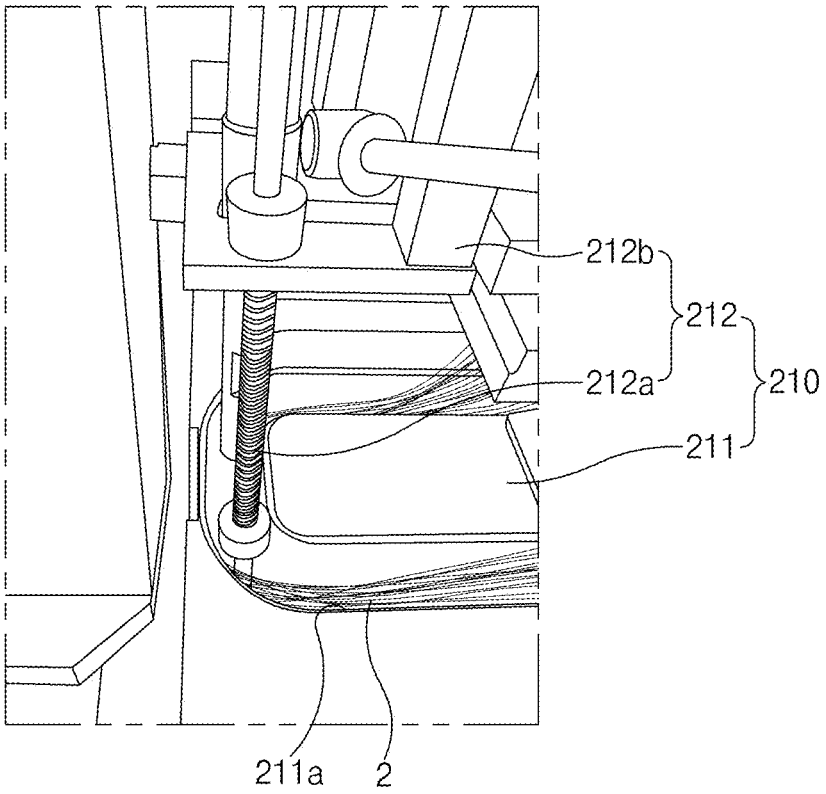
FIGS. 16 to 20 are views illustrating an in-work state of the knotting method according to the present invention.

In step (a), as illustrated in FIGS. 15 and 16, one or more hairs are stored and prepared in a "U"-shape so that centers of the hairs are stably pulled out, and in this case, a hair insertion member 210 of a knotting apparatus 200 is used. That is, a plurality of hairs 2 are inserted into an insertion groove 211*a* of an insertion member 211 having a "U"-shape, and the hairs 2 inserted into the insertion member 211 are pressed by using a pressing member 212.

Figure 17:
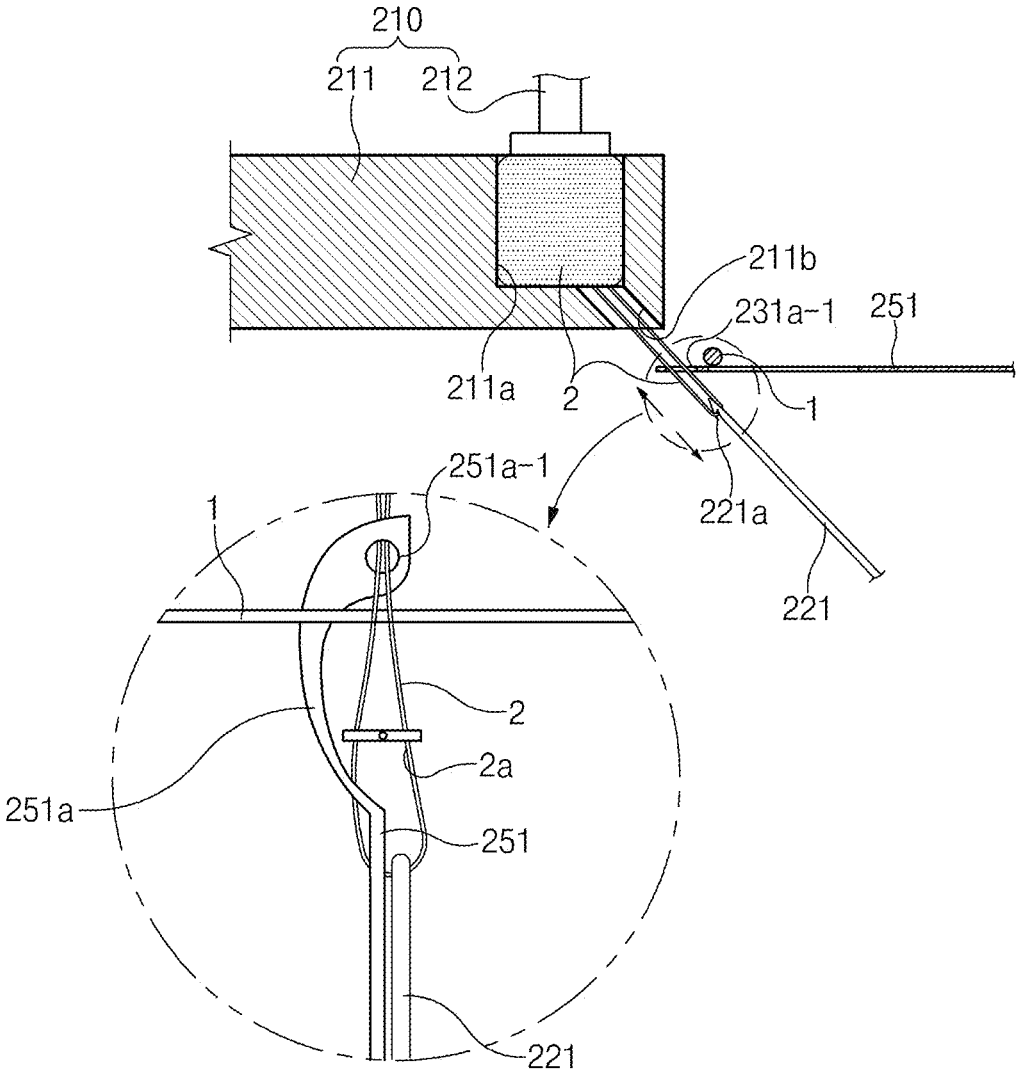

As illustrated in FIGS. 7 and 17, in step (b) in which a predetermined portions of the hairs 2 inserted into the hair insertion member 210 are pulled out, a hair pull-out apparatus 220 of the knotting apparatus 200 is used.

That is, a hair pull-out piece 221 of the hair pull-out member 220 is inserted through a pull-out hole 211*b* of the hair insertion member 210 to grip a hair 2 inserted into an insertion groove 211*a*, the hair is then pulled out to be positioned past a portion under the thread 2, and a knotting hole 2*a* is formed while the thread 1 and the hair 2 are connected (see a bottom perspective view of FIG. 17).

Figure 18:
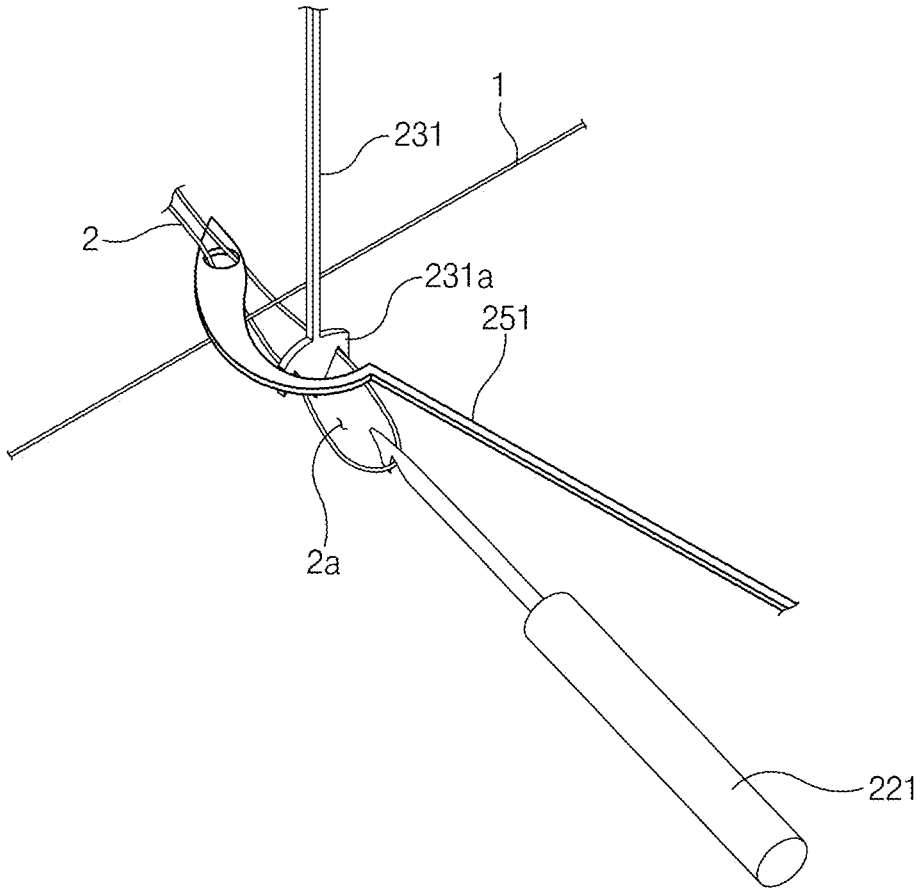

As illustrated in FIGS. 12 and 18, in step (c) in which the knotting hole 2*a* formed while being pulled by the hair pull-out member 220 is expanded, a hair expanding member 230 of the knotting apparatus 200 is used. That is, a hair expanding piece 231 of the hair expanding member 230 is moved toward the knotting hole 2*a*, and in this case, an "M"-shaped expanding part 231*a* presses the both end portions of the hair having formed the knotting hole 2*a*, and thus, the knotting hole 2*a* may be expanded while both the end portions of the hair 2 are gradually separated from each other.

Figure 19:
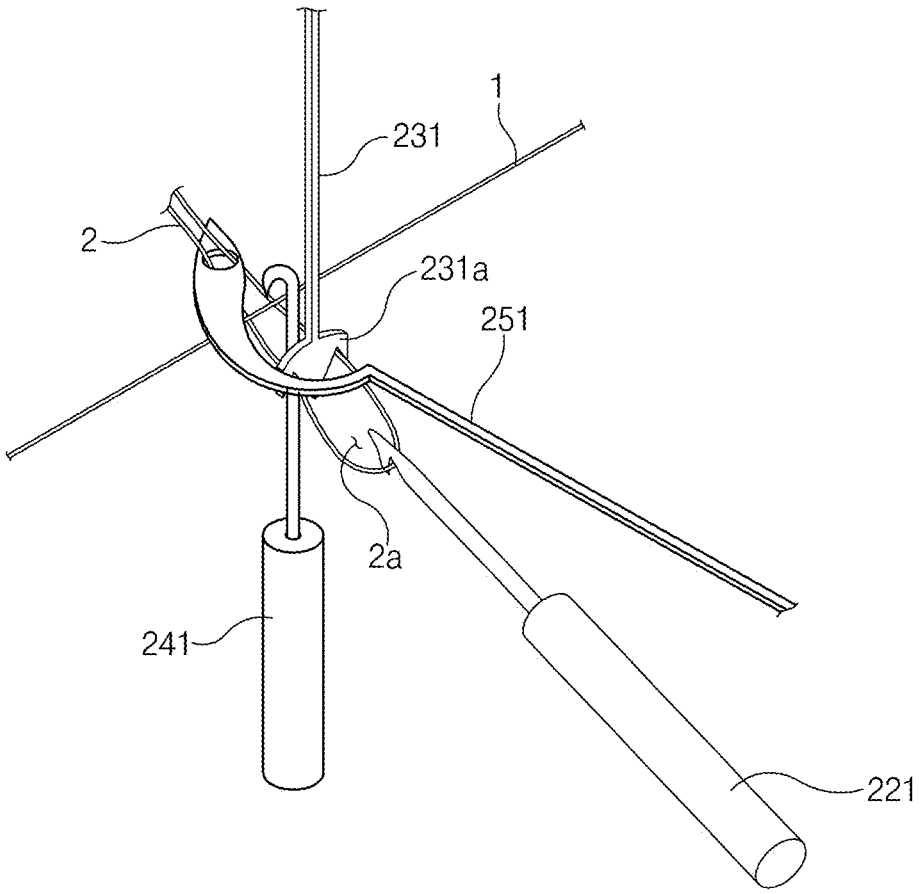

As illustrated in FIG. 19, in step (d), in which a knot is formed by using the hairs 2 pulled out from the hair insertion member 210, a hair knotting member 240 of the knotting apparatus 200 is used. That is, a hair knotting piece 241 of the knotting member 240 passes through the knotting hole 2*a* form bottom to top, and the hair 2 is then knotted onto the thread 1 while the both end portions of the hair 2 are wound by means of the hair winding member 250.

Figure 20:
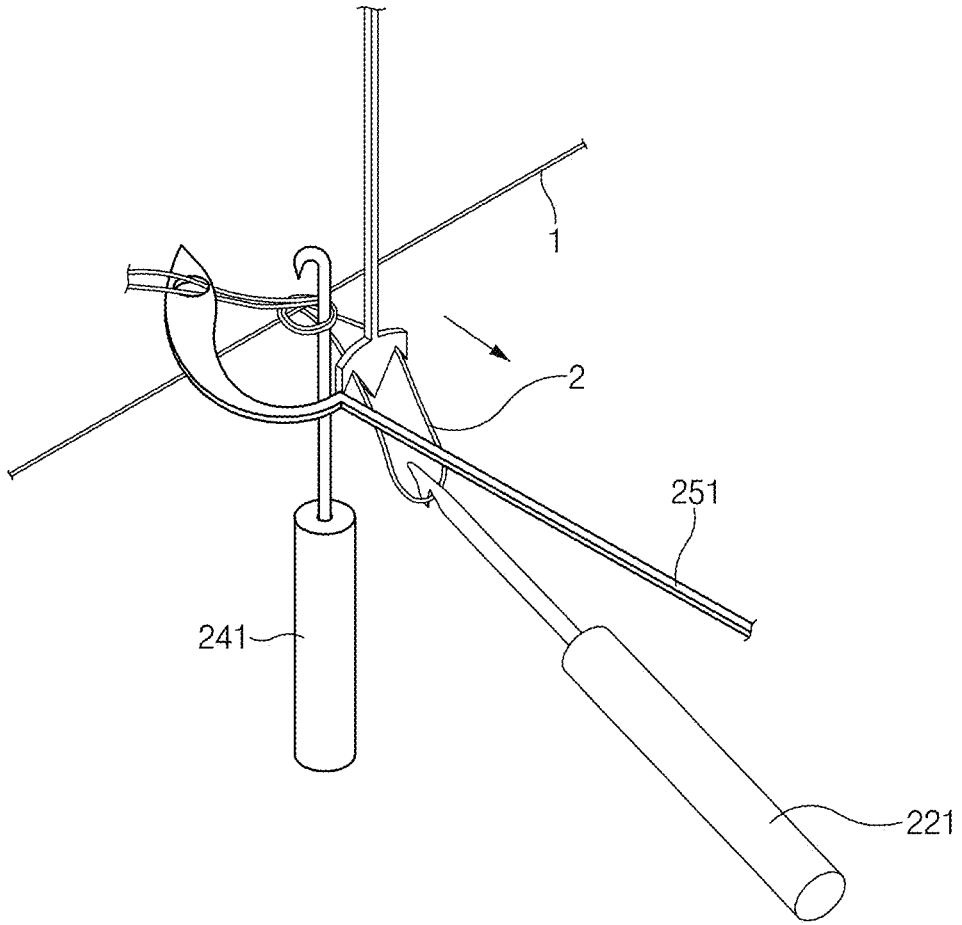

As illustrated in FIG. 20, in step (e), in which both legs of the hair are wound for knotting, a hair winding member 250 is used. That is, both the legs of the hair 2 positioned on the hair insertion member 250 are picked up and wound one or more turns around the hair knotting member 240 while being rotated around the circumferential surface of the hair knotting member 240. That is, both legs of the hair 2 are wound around the circumferential surface of the hair knotting member 240.

Figure 21:
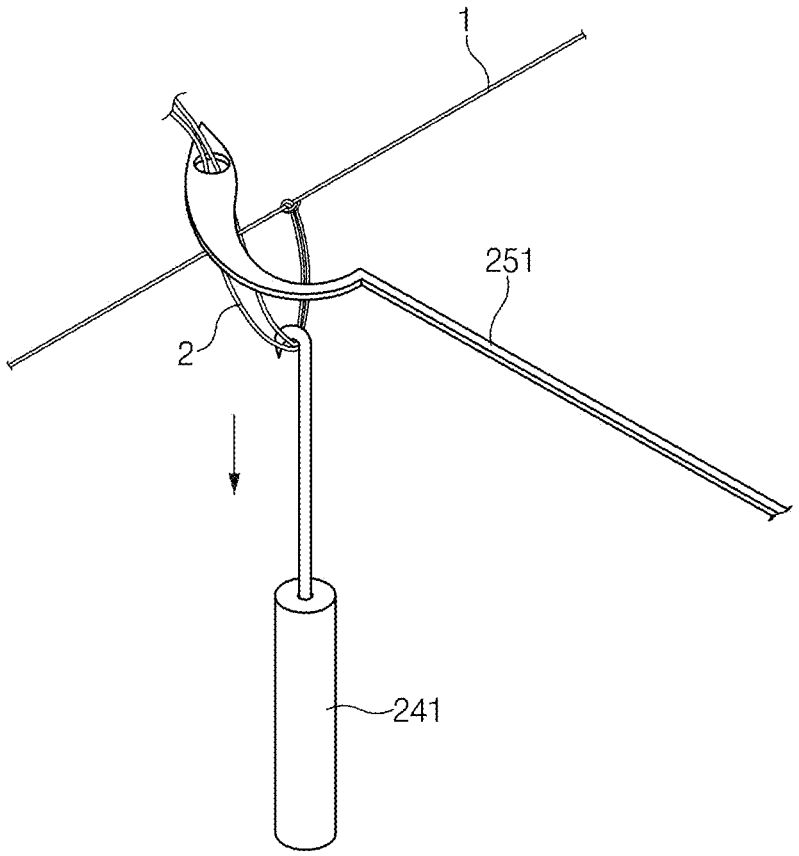
FIG. 21 is a view schematically illustrating a hair knotting step.
Figure 22:
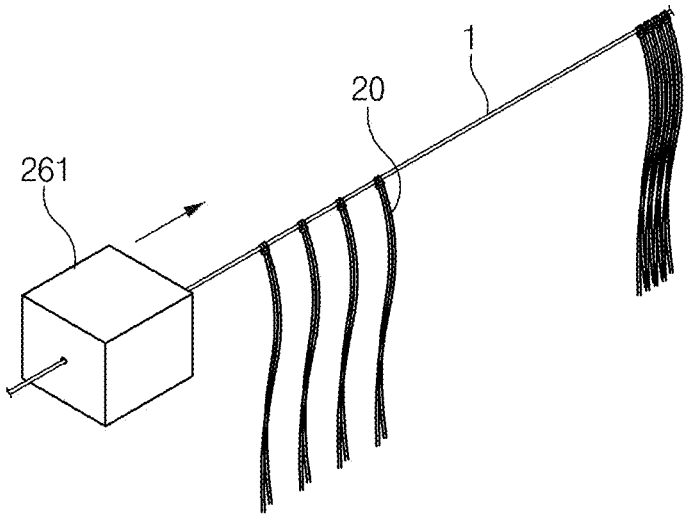
FIG. 22 is a view schematically illustrating a hair recovering step.

As illustrated in FIG. 21, in step (f), when the hair knotting member 240 is moved to a portion under the knotting hole 2*a*, both legs of the hair 2 wound around a hanging hook 241*a* of the hair knotting member 241 are hung and pulled and a knot is thereby formed.

In step (g), in which the knotted hair 20 knotted onto the thread 1 in step (f) is biased in one direction and densely disposed, a hair moving member 260 is used.

That is, while the hair moving member 260 is moved from one side to the other side of the thread 1 by a seventh driving member 262, the knotted hair knotted onto the thread 1 is moved to and aligned on the other side of the thread 1.

As illustrated in FIGS. 14 and 17, in step (h), in which the hairs 2 remaining in the pull-out hole 211*b* of the hair insertion member 210 are removed, a hair recovering member 271 is moved toward the pull-out hole 211*b* of the hair insertion member 210 by an eighth driving member 272, and then picks up the hair 2 remaining in the hair insertion member 210, and in this state, when the hair recovering member 271 is returned to an original position by means of the eighth driving member 272, the hair recovering member 271 pulls the hairs remaining in the hair insertion member 210 and thereby removes the hair 2.

The hairs 2 may be automatically knotted on the thread 1 by continuously performing the above-mentioned processes.

[Wig Producing Method]

Figure 23:
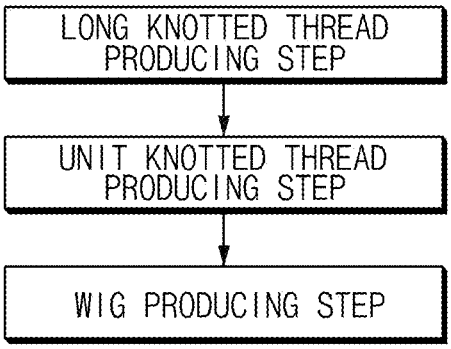
FIG. 23 is a flowchart illustrating a method for producing a wig to which a knot system according to the present invention is applied.

A method for producing a wig according to the present invention, as illustrated in FIG. 23, includes a long knotted thread producing step (A), a unit knot thread producing step (B), a unit knot thread attaching step (C), and a wig producing step (D).

Figure 24:
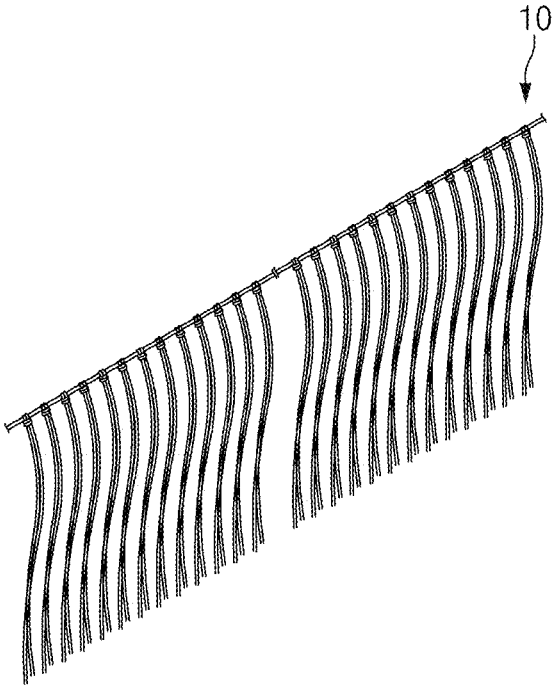
FIGS. 24 to 26 are views illustrating an in-work state of the method for producing a wig according to the present invention.
Figure 25:
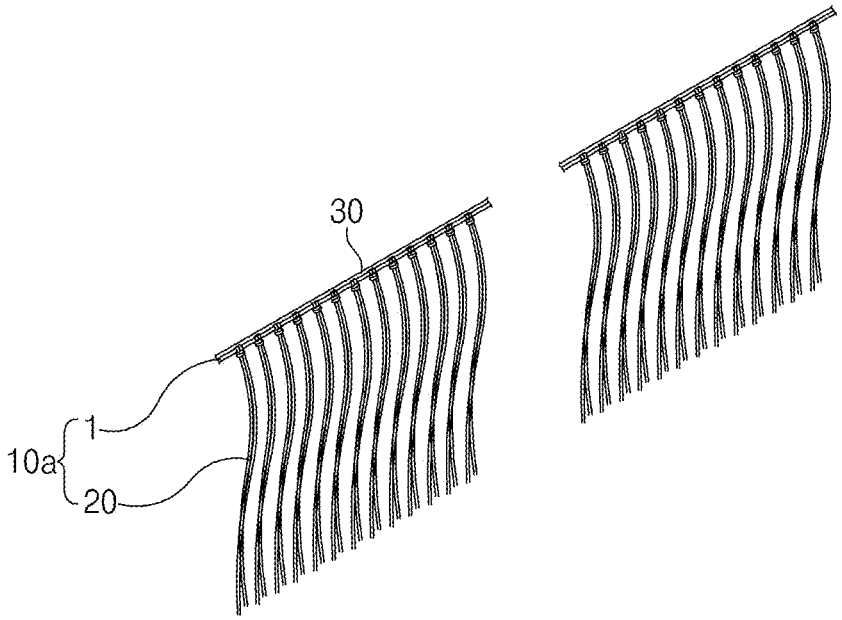
Figure 26:
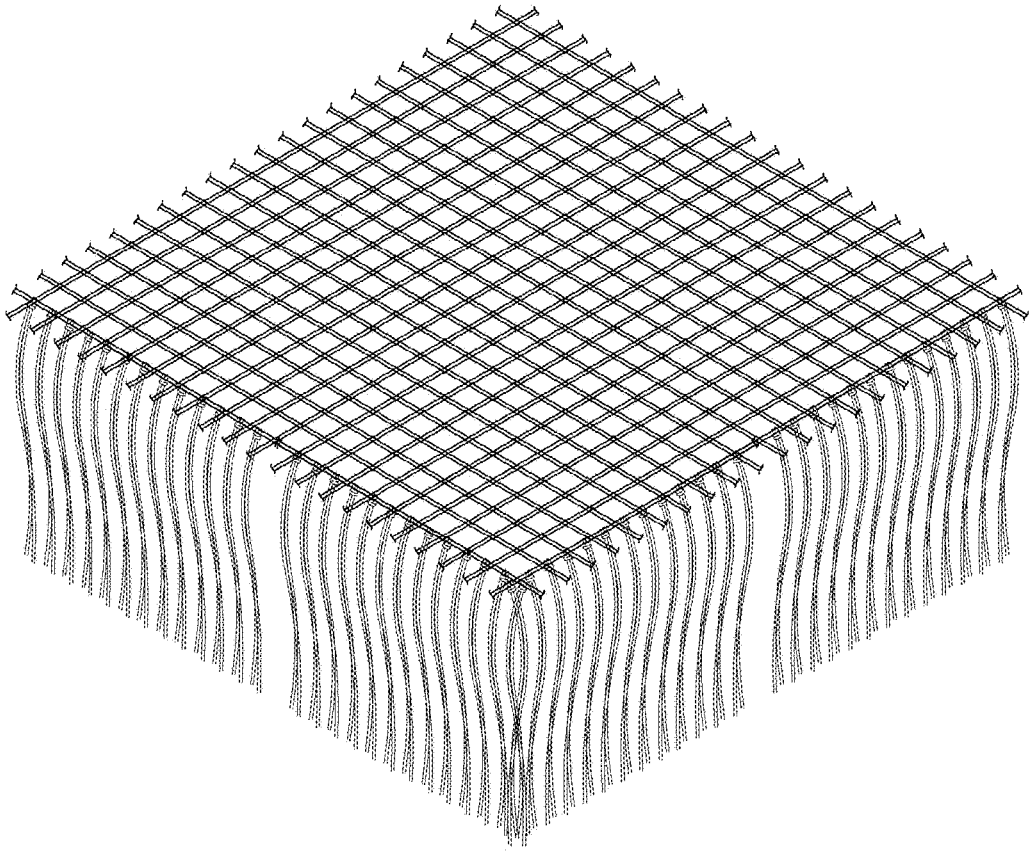

That is, in step (A), as illustrated in FIG. 24, a long knotted thread 10, onto which a plurality of knotted hairs 20 are knotted through the above-mentioned knotting method, is produced. In step (B), as illustrated in FIG. 25, the knotted thread 10 is cut into a predetermined sized to manufacture unit knotted threads 10*a*. In step (C), an adhesive 30 is applied to the unit knotted threads 10*a* and the knotted hairs 20 are attached to the threads 1. In step (D), as illustrated in FIG. 26, the unit knotted threads 10 are aligned horizontally and vertically and then woven by a thread (not shown) to produce a wig 40.

As such, according to the present invention, hairs may be automatically knotted onto threads, and a wig is thereby produced by using the threads onto which the hairs are knotted as such, and thus, work efficiency may be enhanced.

The scope of the present invention is indicated by claims described later rather than by the above-mentioned description, and all of changed or modified forms derived from the meaning and scope of the claims and equivalent meanings thereto should be interpreted as being included in the scope of the present invention.

The invention claimed is:

1. A hair knotting system comprising one or more hair knotting apparatuses installed in a feeding direction of a thread and configured to knot one or more hairs to the thread, the hair knotting apparatus comprising:

a hair insertion member having an insertion groove configured for the one or more hairs being inserted therein, and a pull-out hole formed on a bottom surface of the insertion groove;

a hair pull-out member for picking up and pulling out the one or more hairs, inserted in the insertion groove, through the pull-out hole so that the one or more hairs are positioned past an area under the thread, and forming a knotting hole as the thread and the one or more hairs connect;

a hair knotting member passing through the knotting hole from bottom to top so as to be positioned above the thread; and a hair winding member for picking up both end portions of the one or more hairs pulled out from the hair insertion member, and winding both the end portions of the one or more hairs while rotating around the hair knotting member above the thread, wherein the hair knotting member is configured to knot the one or more hairs onto the thread by pulling down, through the knotting hole, both end portions of the one or more hairs wound around a circumferential surface of the hair knotting member.

2. The knotting system of claim 1, wherein the inserting groove is formed in a U-shape opened upward, and the pull-out hole is formed on a center of a bottom surface of the inserting groove formed in the U-shape.

3. The knotting system of claim 1, wherein the hair insertion member includes a pressing member for pressing the one or more hairs inserted in the inserting groove.

4. The knotting system of claim 1, wherein the hair pull-out member comprises:

a hair pull-out piece which linearly moves so as to be inserted into or pulled out from the pull-out hole and has a hanging hook which is formed on a tip of the hair pull-out piece wherein the hanging hook is configured to hang the one or more hairs inserted into the inserting groove; and a first driving member for linearly moving the pull-out member.

5. The knotting system of claim 1, wherein the hair knotting member comprises:

a hair knotting piece which linearly moves so as to be inserted into or pulled out from the knotting hole from bottom to top, and has a hanging hook which is formed on a tip of the hair knotting piece, wherein the hanging hook is configured to hang and pick up the one or more hairs wound around the tip; and a third driving member for linearly moving the hair knotting member.

6. The knotting system of claim 1, wherein the hair winding member comprises:

a winding piece comprising a linear part provided on one side of the winding member, and a curved part provided on the tip of the linear part, protruding in a direction toward the hair knotting member, wherein a winding hole which is formed at the curved part is configured to receive the one or more hairs pulled out from the insertion hole; and a fourth driving member which moves the winding member so that the curved part of the winding member passes through the hair knotting member and returns to a predetermined position which is between the thread and the insertion member, wherein when the winding member is moved and passes through the hair knotting member by means of the fourth driving member and returns to the predetermined position, the one or more hairs having passed through the winding hole is wound around the hair knotting member and knotted while the winding hole is rotated one turn around the knotting member.

7. The knotting system of claim 1, further comprising a hair expanding member which causes both end portions of the one or more hairs having passed the thread to be further separated from each other and thereby expands the knotting hole.

8. The knotting system of claim 7, wherein the hair expanding member comprises:

a hair expanding piece provided above the one or more hairs, positioned past the area under the thread, so as to be movable in a vertical direction, and having an M-shaped groove on which both ends of the one or more hairs are hung and further separated from each other; and a second driving member for moving the hair expanding member in the vertical direction.

9. The knotting system of claim 1, further comprising a hair moving member for moving one or more knotted hairs which has been knotted onto one side of the thread to the other side of the thread.

10. The knotting system of claim 9, wherein the hair moving member comprises:

a moving piece which linearly moves in a lengthwise direction of the thread, has a through hole through which the thread passes, and moves the one or more knotted hairs knotted onto the thread while a through hole through which the thread passes; and a fifth driving member for linearly moving the moving piece.

11. The knotting system of claim 1, further comprising a hair recovering member which picks up one or more hairs, which has not yet been knotted by the hair knotting member, and moves the one or more hairs to a predetermined place to recover the one or more hairs.

12. The knotting system of claim 11, wherein the hair recovering member comprises:

a hair recovering piece which linearly moves toward the pull-out hole of the hair insertion member and picks up the hair pulled out from the pull-out hole on a tip of the hair recovering piece and moves the one or more hairs to a predetermined place; and a sixth driving member for linearly moving the hair recovering piece.

13. The knotting system of claim 1, further comprising a thread supply apparatus for supplying the thread from one side to another side of the thread supply apparatus.

14. A knotting method comprising:

(a) a step of inserting one or more hairs into an insertion groove of a hair insertion member;

(b) a step of inserting a hair pull-out member into a pull-out hole of the hair insertion member and picking up the one or more hairs inserted into the insertion groove, then pulling out the one or more hairs so that the one or more hairs are positioned past an area under a thread, and then forming a knotting hole while the thread and the one or more hairs are connected;

(d) a step of moving a hair knotting member to pass through the knotting hole from bottom to top;

(e) a step of winding both end portions of the hair pulled out from the pull-out hole around the hair knotting member positioned above the thread by using a hair winding member; and (f) a step of pulling down, through the knotting hole, both the end portions of the one or more hairs wound around the hair knotting member, thereby knotting the one or more hairs onto the thread.

15. The knotting method of claim 14, comprising (c) a step of expanding the knotting hole by using a hair expanding member, between steps (b) and (d).

16. The knotting method of claim 14, comprising (g) a step of moving and aligning one or more knotted hairs on the thread using a moving piece of a hair moving member that passes linearly along the thread in a lengthwise direction, wherein the moving piece has a hole through which the thread passes.

17. The knotting method of claim 16, comprising (h) a step of picking up the one or more hairs, which has not yet been knotted by the hair knotting member, from the pull-out hole and moving the one or more hairs to a predetermined place using a hair recovering member, thereby recovering the one or more hairs, after step (g).

* * * * *